US006048276A

United States Patent [19]

Vandergrift

[11] Patent Number: 6,048,276

[45] Date of Patent: Apr. 11, 2000

[54] PIEZOELECTRIC GOLF CLUB SHAFT

[75] Inventor: James A. Vandergrift, Seattle, Wash.

[73] Assignee: K-2 Corporation, Vashon, Wash.

[21] Appl. No.: 09/105,762

[22] Filed: Jun. 26, 1998

[51] Int. Cl.[7] ..... A63R 53/10; A63R 53/12

[52] U.S. Cl. ..... 473/316; 310/326

[58] Field of Search ..... 473/316–323, 473/282, 521; 310/326

[56] References Cited

U.S. PATENT DOCUMENTS

| | | | |
|---|---|---|---|
| 4,070,022 | 1/1978 | Braly | 473/289 |
| 5,036,241 | 7/1991 | Michaelis | 310/358 |
| 5,575,722 | 11/1996 | Saia | 473/318 |
| 5,620,260 | 4/1997 | Ide | 384/122 |
| 5,857,694 | 1/1999 | Lazarus | 473/318 |

*Primary Examiner*—Jeanette Chapman
*Assistant Examiner*—Stephen L. Blau
*Attorney, Agent, or Firm*—Christensen O'Connor; Johnson & Kindness PLLC

[57] ABSTRACT

A golf club shaft (10) incorporating a piezoelectric device (12) which, upon deflection or deformation of the golf club shaft (10) caused by swinging of the golf club shaft, selectively stiffens a section of the golf club shaft. The piezoelectric device (12), includes a sensor (24) located along the golf club shaft (10) and configured such as to produce an electrical signal upon flexing of the golf club shaft. A piezoelectric stiffener (22) is electrically connected to the sensor (24), is located along the golf club shaft (10), and is designed to mechanically deform as a result of receiving the electrical signal from the sensor (24). The mechanical deformation of the piezoelectric stiffener (22) causes a corresponding deformation of the golf club shaft (10).

13 Claims, 8 Drawing Sheets

PIEZOELECTRIC GOLF CLUB SHAFT

FIELD OF THE INVENTION

This invention relates to a golf club shaft and, more particularly, a golf club shaft utilizing piezoelectric material to selectively stiffen a portion of the golf club shaft.

BACKGROUND OF THE INVENTION

As many amateurs are aware, a golf swing is difficult to perform correctly and consistently. One of the most important aspects of the golf swing is timing the club head to strike the ball consistently. First, a golfer must accurately align the club face to the target. Second, accurate timing must be used to optimize the transfer of energy from the club head to the ball so as to achieve the maximum distance.

Considerable study has been given to "swing timing," which correlates the swing speed of a golfer to stiffness of the golf club shaft. When matched with a golf club shaft having proper stiffness, a golfer can significantly increase the distance the ball is hit by using the stored flex energy of the shaft to add acceleration to the ball.

A powerful golfer with a high velocity swing will benefit most from a stiffer, heavier shaft. This type of player can accelerate the club quickly and cause the stiffer shaft to load properly on the down swing. When the powerful golfer's swing progresses to the unloading stage, the stiffer shaft is strong enough to spring forward to achieve the best club face alignment and maximize club head velocity at impact.

If the same golfer were to use a more flexible shaft, he or she would have to slow down swing velocity so the shaft would have more time to load and unload. Distance would be sacrificed and accuracy would suffer because the golfer's natural swing tempo would been interrupted.

A player with slower swing mechanics benefits from a more flexible shaft. At lower club head speeds, this type of player is able to achieve optimum loading and unloading with the more flexible shaft. A soft flexing club that is properly matched to the slower swing speed uses the "kick" of the golf club shaft to give the ball extra acceleration.

If a golf club shaft is too stiff for a player's swing mechanics, the player will not be able to load and unload the shaft fully. The golf club shaft will feel stiff, and the golfer will lose both distance and accuracy.

A typical weekend golfer does not exhibit a consistent swing speed over the course of a round. Although the golfer may be capable of generating club head speeds up to 110 mph, some of the golfer's swings during the day can be significantly slower, such as 75 mph. Matching the proper flexibility of a golf club shaft to such a golfer can be difficult. Although the golfer may need a stiffer golf club shaft for some of the faster swings, the stiff golf club shaft may not be loaded or unloaded properly on slower swings. If the golfer utilizes a more flexible golf club shaft, the golf club shaft may be too flexible or soft for the higher swing speeds, and may not properly load and unload on the fast swings. The golfer will be required to slow down the swing in all cases so as to make proper contact with the ball, and will lose distance and accuracy in the process.

There is a need for a golf club shaft that can be used by a golfer with inconsistent swing speeds. Preferably, such a golf club shaft would maximize distance and accuracy for range of swing speeds of the golfer.

SUMMARY OF THE INVENTION

The present invention solves many of the above problems by providing a golf club shaft having a piezoelectric device used to selectively stiffen a portion of the golf club shaft. In accordance with one aspect of the invention, the golf club shaft includes a piezoelectric device having a sensor and a piezoelectric stiffener. The sensor is located along the golf club shaft and configured such as to produce an electrical signal upon flexing of the golf club shaft. The piezoelectric stiffener is electrically connected to the sensor, located along the golf club shaft, and designed to mechanically deform as a result of receiving the electrical signal from the sensor. The mechanical deformation of the piezoelectric stiffener causes a corresponding deflection of the golf club shaft.

In accordance with one aspect of the invention, the sensor includes piezoelectric material. The golf club shaft defines kick point, and the piezoelectric stiffener and sensor preferably are located adjacent to the kick point. In one embodiment, the sensor is located on an opposite side of the golf club shaft from the piezoelectric stiffener.

According to one aspect of the invention, the piezoelectric stiffener is located on a forward, target-facing side of the golf club shaft. In this embodiment, the mechanical deformation of the piezoelectric stiffener occurs as compression in length along an axis that is parallel to the longitudinal axis. Alternatively, the piezoelectric stiffener is located upon a trailing, away-from-target side of the golf club shaft. In this embodiment the mechanical deformation of the piezoelectric stiffener occurs as elongation in length along an axis that is parallel to the longitudinal axis.

In accordance with another embodiment of the invention, the piezoelectric device is formed from piezoelectric material that extends substantially around the circumference of the golf club shaft. The piezoelectric stiffener can be formed out of a portion of the piezoelectric material extending around the circumference, and the sensor is formed out of another portion of the piezoelectric material extending around the circumference.

A control circuit can be provided in the electrical connection between the sensor and the piezoelectric device. The control circuit in one embodiment is configured so as to selectively restrict the flow of the electrical signal from the sensor to the piezoelectric stiffener, thus providing mechanical deformations of the piezoelectric stiffener only at selected flexions of the golf club shaft.

In accordance with a further aspect of the present invention, a resistor is provided that bleeds off the electrical signal of the sensor at flexions of the golf club shaft corresponding to lower swing speeds. In such an embodiment, the piezoelectric stiffener stiffens a portion of the golf club shaft at swing speeds higher than the lower swing speeds. The resistor can be a variable resistor.

The piezoelectric stiffener can be configured so that the mechanical deformation at low swing speeds of the golf club shaft causes additional flexing of the golf club shaft. In one such embodiment having a control circuit, the control circuit is configured so as to selectively restrict the flow of the electrical signal from the sensor to the piezoelectric stiffener, thus providing mechanical deformations of the piezoelectric stiffener only at selected flexions of the golf club shaft corresponding to the low swing speeds. The control circuit could include a resistor that bleeds off the electrical signal of the sensor at flexions of the golf club shaft corresponding to swing speeds higher than the low swing speeds. The resistor in one embodiment is designed to bleed off the energy of the sensor at flexions of the golf club shaft intermediate the lower swing speeds and higher swing speeds. Finally, the mechanical deformations could cause the piezoelectric stiffener to stiffen the golf club shaft at the higher swing speeds.

In accordance with yet another aspect of the invention, the piezoelectric device is an active piezoelectric device having an external power source.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
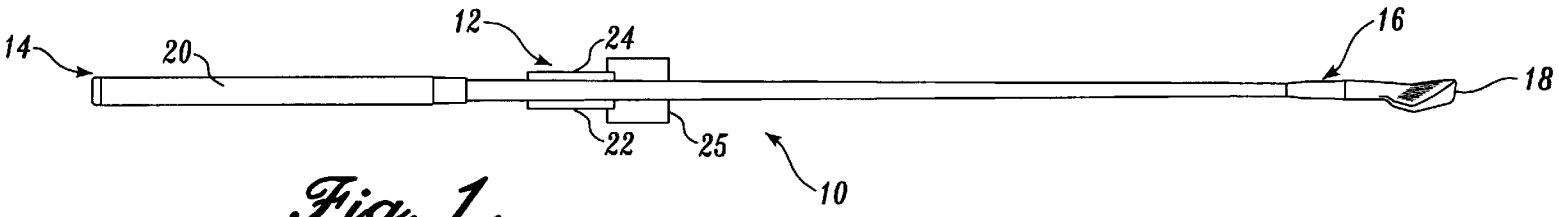
FIG. 1 is a diagrammatic top view of a golf club shaft having a piezoelectric device embodying the present invention.

Referring now to the drawing, in which like reference numerals represent like parts throughout the several views, FIG. 1 discloses a golf club shaft 10 embodying the present invention. Briefly described, the golf club shaft 10 incorporates a piezoelectric device 12 which, upon deflection or deformation of the golf club shaft 10 caused by swinging of the golf club shaft, selectively stiffens a section of the golf club shaft.

The golf club shaft 10 includes a grip end, or butt 14, and a club head end, or tip 16. A club head 18 fits over the tip 16 of the golf club shaft 10. A grip 20 extends around the butt 14 and along approximately ten inches of the golf club shaft 10. The golf club shaft 10 is preferably made of a carbon-fiber composite, but can be made of steel, boron/graphite, titanium/graphite, wood, or any other suitable material.

The piezoelectric device 12 shown in FIG. 1 includes a piezoelectric stiffener 22 and a sensor 24. A circuit 25 connects the piezoelectric stiffener 22 and the sensor 24. In the embodiment shown in FIG. 1, the piezoelectric stiffener 22 and the sensor 24 are positioned on opposite sides of the golf club shaft 10. The sensor 24 and the piezoelectric stiffener 22 are located on the front and rear sides of the golf club shaft 10 (i.e., the target-facing side, and the away-from-target side), respectively. The circuit 25 preferably is located within the golf club shaft 10, but is shown for ease of understanding as extending outside the golf club shaft in FIG. 1.

Briefly described, the sensor 24 reacts when the golf club shaft 10 flexes as a result of a golf swing, and produces an electrical current. The electrical current is applied through the circuit 25 to or across the piezoelectric stiffener 22. As is known, piezoelectric materials transform an electrical potential to a mechanical response. Shunting the electrical current from the sensor 24 through the piezoelectric stiffener 22 changes the length of the piezoelectric stiffener in a direction parallel with the longitudinal axis of the shaft. Depending on which direction the electric current is shunted through the piezoelectric stiffener 22, the piezoelectric stiffener lengthens or shortens. In the embodiment shown in FIG. 1, the electric current from the sensor 24 causes the piezoelectric stiffener 22 to lengthen, and thereby counteracts bending of the golf club shaft 10 in the region of the piezoelectric stiffener 22.

The piezoelectric stiffener 22 is preferably formed of one or more semicylindrical, elongate piezoelectric materials. The piezoelectric materials are placed in line with each other and spaced slightly longitudinally apart along the outside surface of the golf club shaft 10. Alternatively, the piezoelectric stiffener 22 can be mounted inside the golf club shaft 10 or, if the golf club shaft 10 is made of composite or other layered materials, can be mounted inside layers of the walls of the golf club shaft. The layers can take several forms, such as plates, discs, or even fibers. If fibers are used, those fibers are preferably aligned so that they resist torsional strain or twist in the golf shaft.

The piezoelectric materials are preferably lead zirconium titanate (pzt) type piezoelectric materials, preferably of the 5A or 5H variety, which readily available. However, many other materials such as quartz and barium titanate, and other ceramic materials and inorganic crystals that are known to exhibit piezoelectric characteristics can be used. Some organic polymers, such as polyvinyl fluoride, and polyvinyl chloride, also exhibit some piezoelectric properties when properly treated, and can also be used for this invention. Piezoelectric organic polymers are advantageous because they may be more easily formed into thin films or other shapes. Organic polymer piezoelectric films can also be fabricated so that they are both flexible and lightweight. One or more layers of the films can by bound together to form a biomorph in a manner well known in the art. Such a biomorph provides increased mechanical deflections.

The sensor 24 can also be formed of piezoelectric materials. As is known, when a piezoelectric material undergoes mechanical deformations, the piezoelectric material produces an electrical potential. If the sensor 24 is formed of piezoelectric materials, the piezoelectric materials can be arranged along the golf club shaft 10 so that deflection of the golf club shaft produces an electrical potential that in turn can be directed to the piezoelectric stiffener 22. Alternatively, the sensor 24 can be formed from any material or device that produces an electrical potential as a result of flexing of the golf club shaft 10. For example, the sensor 24 can be a strain gauge. If the sensor 24 is formed of piezoelectric materials, the sensor 24 can be formed of any of the materials described with reference to the piezoelectric stiffener 22, such as ceramic, inorganic crystal, organic polymer piezoelectric materials, or any other suitable materials. In addition, polyvinylidene fluoride (PVF2), can be used because of that material's ability to produce a large electrical signal responsive to a small deformation. It may be advantageous to form the piezoelectric sensor from organic polymers due to their ability to be easily formed into thin films of particular shapes, so as to match the outside surface of the golf club shaft 10.

In order to transfer the greatest amount of strain energy into the piezoelectric stiffener 22, it is advantageous that the piezoelectric sensor 24 be placed in an area of high deformation along the golf club shaft 10. It has been found that placing the sensor 24 at the "kick point" of the golf club shaft provides the maximum electric potential from the sensor 24. The kick point is the point at which a golf club shaft bends the greatest amount when the golf club shaft is at or near maximum deflection.

Figure 2:
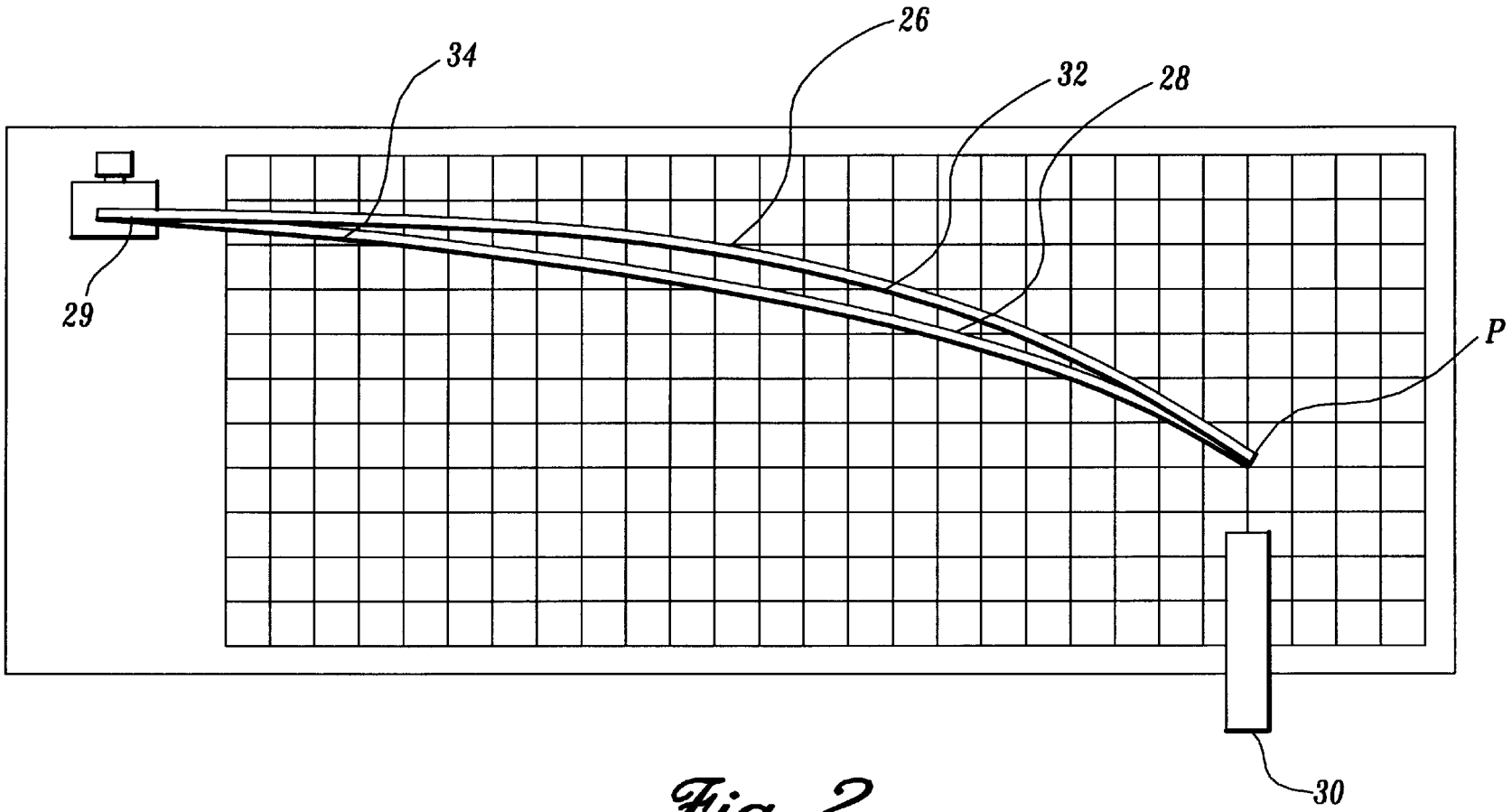
Fig. 2. PRIOR ART
FIG. 2 is a graph displaying deflection of two prior art golf club shafts.

FIG. 2 diagrammatically displays the deflection of two prior art golf club shafts 26, 28 having kick points 32, 34 located at different locations on the golf club shafts. In the deflection graph shown in FIG. 2, each of the golf club shafts 26, 28 is fixed at a butt end 29 to extend horizontally. A weight 30 is attached to the tip end of each of the golf club shafts 26, 28. The two golf club shafts 26, 28 are generally the same weight, material, length and relative stiffness. However, as can be seen in FIG. 2, the two shafts 26, 28 show different flex curve characteristics. The tips of both of the golf club shafts 26, 28 deflect to the same point P, but the two shafts have different deflection curves and kick points. The golf club shaft 26 is stiffer in the butt section (the grip end), and more flexible in the tip section. Conversely, the golf club shaft 28 is more flexible in the butt section, and stiffer in the tip section. The kick point 32 for the golf club shaft 26 is the point at which the golf club shaft bends the greatest during deflection and, for the golf club shaft 26, is located near the tip end of the golf club shaft 26. In contrast, the kick point 34 for the golf club shaft 28 is located closer to the grip end of the golf club shaft.

Figure 3:
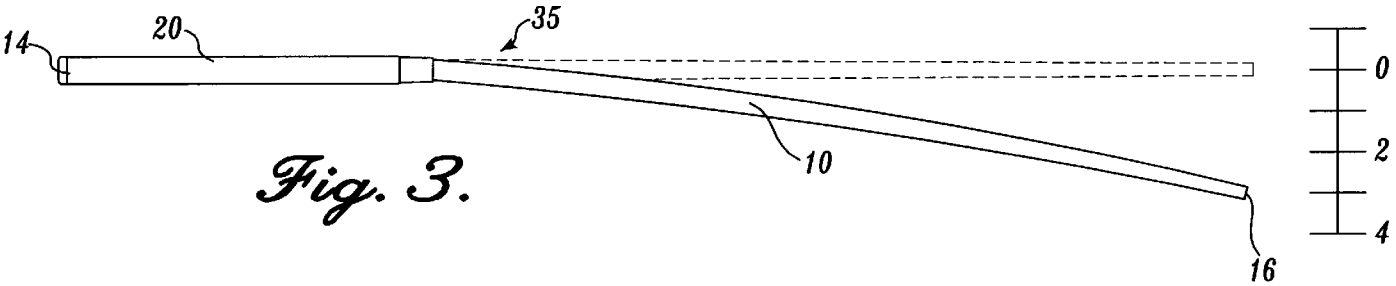
FIG. 3 is a diagrammatic top view displaying high swing deflection of the golf club shaft of FIG. 1.

Referring now to FIG. 3, the golf club shaft 10 has a kick point 35 located adjacent to the grip 20, but slightly toward the tip end 16 of the golf club shaft from the grip. However, the kick point can be located in different locations depending upon the construction of the golf shaft. As stated above, the piezoelectric device 12 is preferably located at the kick point 35 of the golf club shaft 10. However, the piezoelectric device 12 can be arranged in different locations along the golf club shaft so as to produce a desired performance, or can be constructed so as to extend the length of the golf club shaft.

Figure 4:
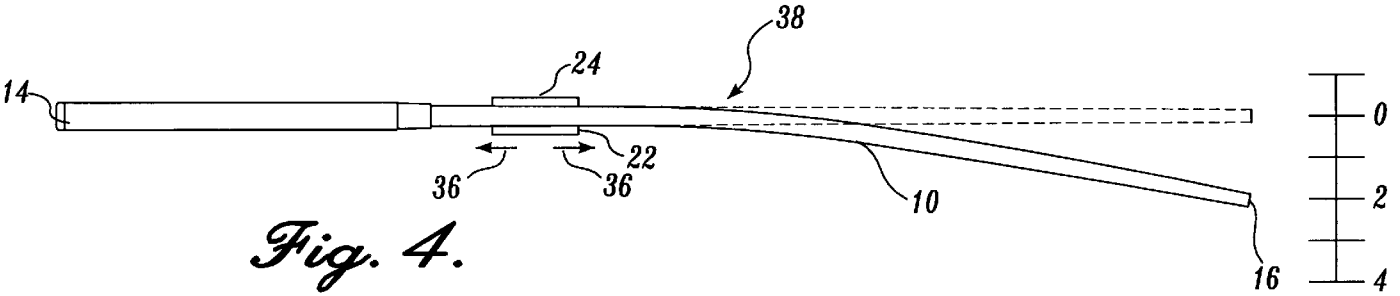
FIG. 4 is a diagrammatic top view displaying high-speed deflection of the golf club shaft of FIG. 1, with the piezoelectric device activated.

FIGS. 3 and 4 show the effect of the piezoelectric device 12 on deflection of the golf club shaft 10 and location of the kick point 35 of the golf club shaft 10. FIG. 3 shows high swing speed deflection of the golf club shaft 10 without the effect of the piezoelectric device 12. Without the piezoelectric device 12, the golf club shaft 10 exhibits a kick point 35 adjacent to the grip 20. The tip 16 of the golf club shaft 10 is deflected to the third notch on the deflection grid.

FIG. 4 shows high swing speed deflection of the golf club shaft 10 with the piezoelectric device 12 activated. The figure depicts the effects of the same fast swing utilized on the golf club shaft 10 in FIG. 3. The sensor 24, upon flexing of the golf club shaft 10, produces an electrical potential. This electrical potential is shunted through the piezoelectric stiffener 22, causing the piezoelectric stiffener to lengthen as is indicated by the arrows 36. This lengthening of the piezoelectric stiffener 22 causes the golf club shaft 10 to stiffen in the region of the piezoelectric stiffener. The stiffening of the golf club shaft 10 prevents bending of the golf club shaft about the kick point 35, and instead causes bending of the golf club shaft at a removed kick point 38. In addition, the deflection of the golf club shaft 10 is less than that of the golf club shaft without the piezoelectric device 12 (FIG. 3), as is indicated by the fact that the tip 16 is deflected only to the second notch of the deflection grid in FIG. 4. Thus, the piezoelectric device 12 not only alters deflection of the golf club shaft 10, but also moves the location of the kick point along the golf club shaft.

If the golf club shaft 10 is swung harder or faster, then more electric potential will be produced by the sensor 24 and shunted through the piezoelectric stiffener 22. The increase in energy provides more stiffening of the piezoelectric stiffener 22, causing the piezoelectric device 12 to further counteract and prevent bending of the golf club shaft. By carefully choosing the materials for the sensor 24 and the piezoelectric stiffener 22, a golf club shaft 10 can be designed to be properly responsive to a variety of different swing speeds. If the golf club shaft 10 is swung fast, the piezoelectric stiffener 22 will stiffen the shaft so that the golf club shaft will behave such as a stiff shaft, enabling a user to properly align the club head to the ball during the swing. Alternatively, if the user swings the club slowly, the piezoelectric device 22 will relax to allow the golf club shaft 10 to fully flex, allowing the golf club shaft to "kick" so that the golf club shaft will give the ball extra acceleration. Intermediate swings will cause partial stiffening of the piezoelectric stiffener 22, which results in partial stiffening of the club to produce an intermediate kick of the golf club shaft.

Figure 5:
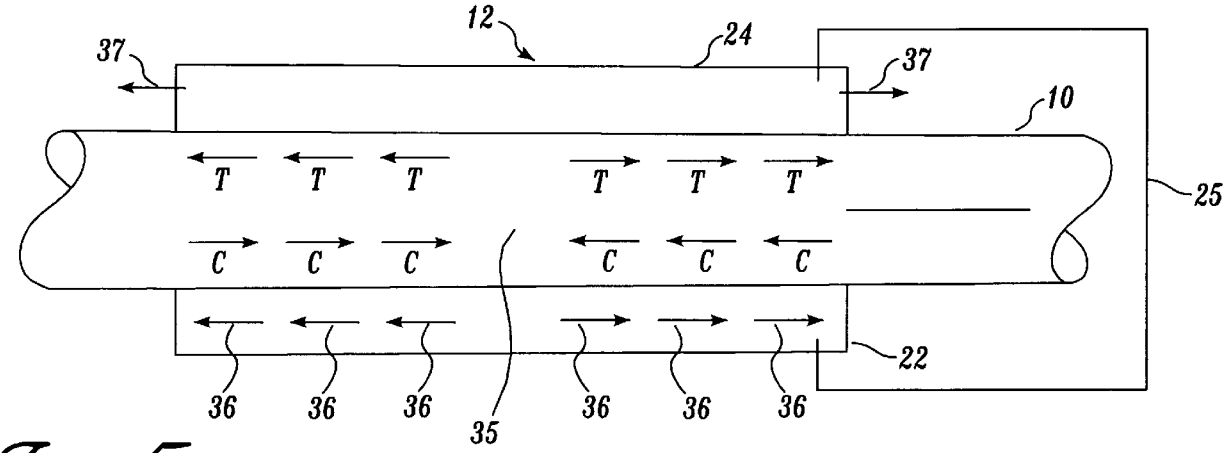
FIG. 5 is a diagrammatic top view of a portion of the golf club shaft of FIG. 1 adjacent to the piezoelectric device, showing tension and compression within the golf club shaft during high-speed deflection.

FIG. 5 shows how the piezoelectric stiffener 22 counteracts and prevents bending of the golf club shaft 10 about the normal kick point 35 for the golf club shaft. When a golf club shaft 10 is swung, the kick point for the golf club shaft is put in tension at the forward surface of the golf club shaft (indicated by the arrows T in FIG. 5), and the rearward surface of the golf club shaft is put into compression (indicated by the arrows C in FIG. 5). The tension at the forward face of the golf club shaft 10 causes a corresponding tensile strain (indicated by the arrows 37) across the sensor 24. The tensile strain causes the sensor 24 to produce an electrical potential, which is shunted through the circuit 25 to the piezoelectric stiffener 22. The electrical potential causes the piezoelectric stiffener 22 to expand, as is indicated by the arrows 36 in FIG. 5. The expansion of the piezoelectric stiffener 22 counteracts the attempted compression of the rearward side of the golf club shaft 10, and thus substantially prevents bending of the golf club shaft at the kick point 35.

Figure 6:
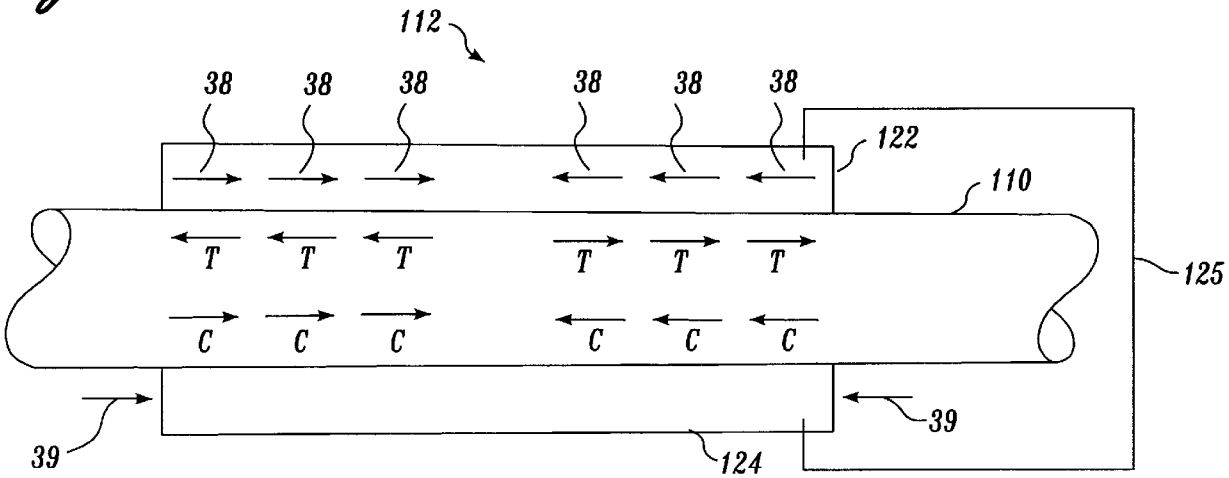
FIG. 6 is a diagrammatic top view, similar to FIG. 5, of a portion of a second embodiment of a golf club shaft embodying the present invention, with the piezoelectric stiffener of the piezoelectric device located on the opposite side of the golf club shaft than in FIG. 1.

In an alternative embodiment of a piezoelectric device 112 shown in FIG. 6, the piezoelectric stiffener 122 is located on the forward portion of the golf club shaft 10, and the sensor 124 is located on the rearward portion of the shaft. In this embodiment, the sensor 124 is placed in compression (indicated by the arrows 39) upon deflection of the golf club shaft, and an electrical potential is produced as a result of the compression. The electric potential is shunted through the piezoelectric stiffener 122, causing the piezoelectric stiffener to contract, as is indicated by the arrows 38 in FIG. 6. The contraction of the piezoelectric stiffener 122 counteracts the tensile strain at the forward face of the golf club shaft 110. In this manner, the piezoelectric stiffener 122 counteracts the tensile strain at the forward side of the golf club shaft 110, and thereby minimizes deflection. Because piezoelectric materials are often stronger in compression, the embodiment shown in FIG. 6 may be utilized to provide a stronger counteracting force against bending of the golf club shaft 10.

Figure 7:
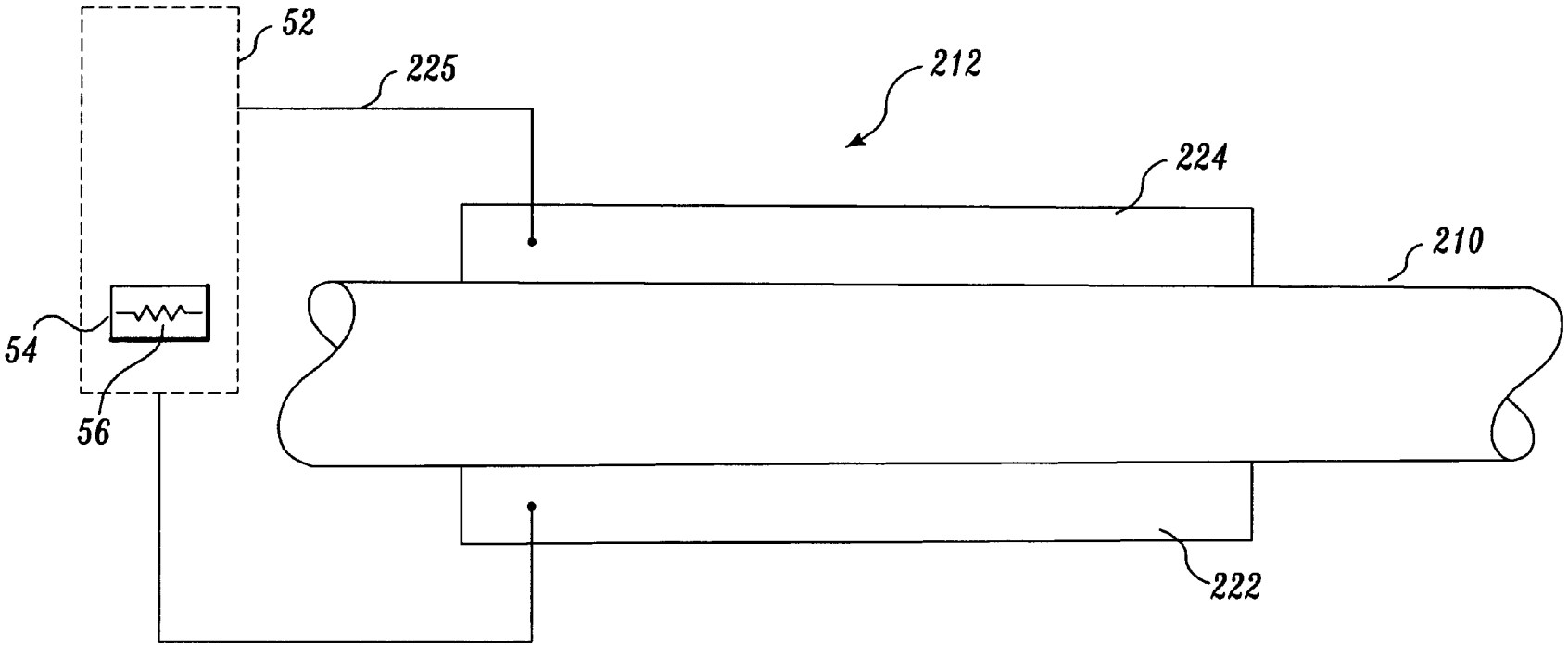
FIG. 7 is a diagrammatic top view of a third embodiment of the present invention incorporating a control circuit that permits stiffening of the golf club shaft only at selected swing speeds.

In an alternate embodiment of the invention diagramed in FIG. 7, a piezoelectric device 212 is incorporated in the golf club shaft 210 and is tailored to provide selective stiffening only at particular resonant frequencies, such as at minimum or maximum deflections of the golf club shaft 10. By using a control circuit 52 located in the circuit 225 for the piezoelectric device 212, the performance of the golf club shaft 210 is not affected by the piezoelectric device 212 unless the golf club shaft reaches a certain velocity or is deflected a particular amount. To provide this function, the control circuit 52 is placed in the circuit 225 between the sensor 224 and the piezoelectric stiffener 222. The sensor 224 provides a signal to the control circuit 52, which, depending upon the signal from the sensor 224, activates the piezoelectric stiffener 222 to selectively stiffen a portion of the golf club shaft 10.

The control circuit 52 includes a timing circuit 54 that receives the signal from the sensor 224, and produces a signal indicative of the deformation of the golf club shaft 210. The timing circuit 54 includes a resistor 56 that bleeds offthe energy of the sensor 224 at lower swing speeds, and permits stiffening by the piezoelectric stiffener 224 at higher swing speeds. Using the signal indicative of the deformation of the golf club shaft 210, the control circuit 52 selectively restricts the flow of electricity from the sensor 224 to the piezoelectric stiffener 222, thus providing stiffening of the piezoelectric stiffener only at selected deflections of the golf club shaft 10. Alternatively, the resistor can be arranged so as to bleed-off the energy at the higher swing speeds. Placing the resistor in series or parallel with the sensor produces the opposite effects, as is known in the art. Electrical circuits such as the timing circuit 54 described above are readily known and understood by one of ordinary skill in the electrical control art.

Figure 8:
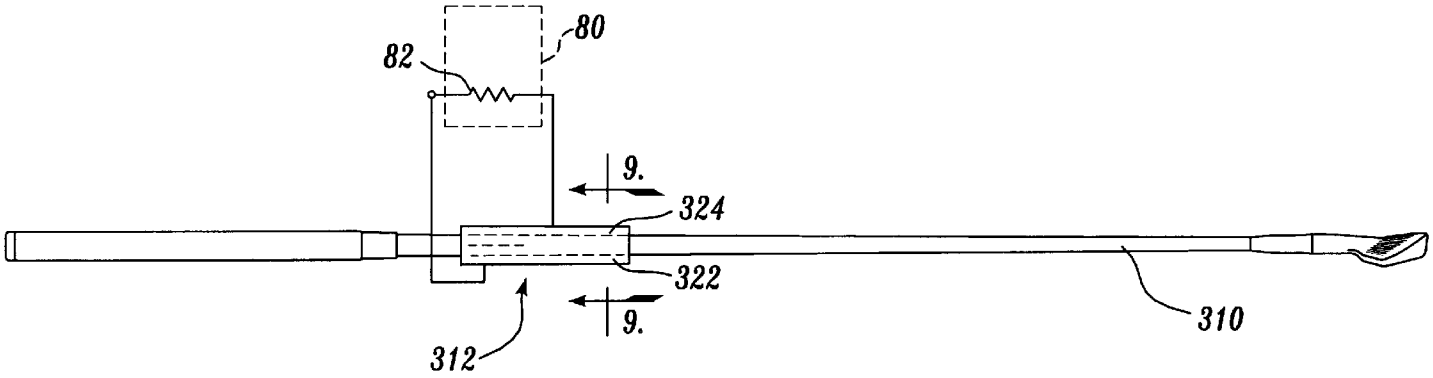
FIG. 8 is a diagrammatic top view of a fourth embodiment of the present invention in which piezoelectric material extends around the circumference of the golf club shaft.
Figure 9:
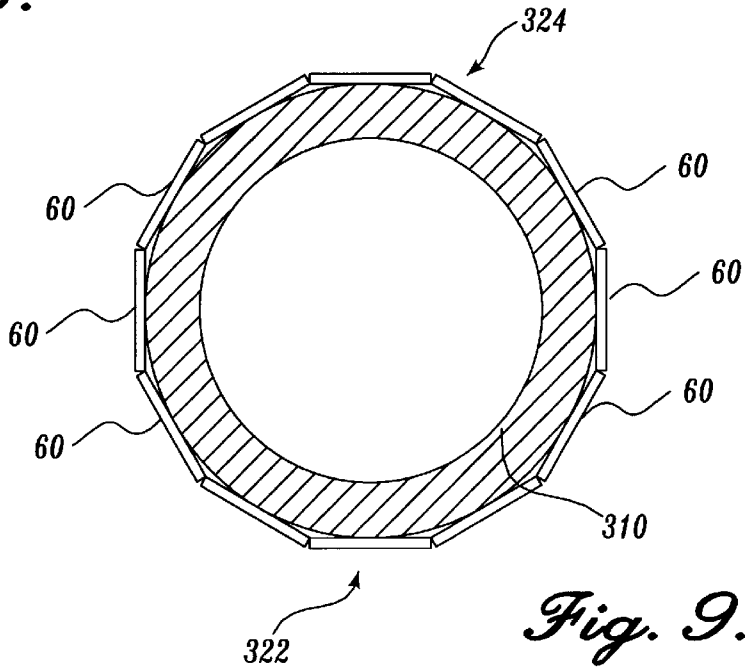
FIG. 9 is a sectional view taken along the section lines 9—9 of FIG. 8.

FIGS. 8 and 9 disclose another golf club shaft 310 incorporating the present invention. The golf club shaft 310 includes a piezoelectric device 312 formed from piezoelectric material 60 (FIG. 9) that extends around the circumference of the golf club shaft. The piezoelectric material 60 can be provided as a series of concentric piezoelectric plates such as is shown in FIG. 9, or can be a single piece that extends around the entire golf club shaft 310. By providing the piezoelectric material 60 in a uniform layer around the entire circumference of the golf club shaft 310, the golf club shaft satisfies the United States Golfer Association's (USGA) rules for symmetry of stiffness of a golf club shaft. In this embodiment, the piezoelectric material 60 on one side of the shaft (indicated by 322) serves the function of the piezoelectric stiffener 22 in the embodiment described above. The piezoelectric material 60 on the other side of the golf club shaft 310 (indicated by 324) serves the function of the sensor 24 in the previously described embodiments. Alternatively, a separate sensor (not shown) can be used that cause all of the piezoelectric material 60 to behave as a piezoelectric stiffener 22. In such an embodiment, the piezoelectric material 60 on the front side of the golf club shaft 310 lengthens (similar to FIG. 5), and the piezoelectric material 60 on the back side of the golf club shaft compresses (similar to FIG. 6) as a response to electrical signals from the sensor.

The piezoelectric device 312 shown in FIG. 8 includes a control circuit 80 between the sensor 324 and the piezoelectric stiffener 322. The control circuit 80 is similar to the control circuit 52 in the previous embodiment, but instead of including the resistor 56, includes a variable resistor 82. The variable resistor 82 permits the golfer to set the level at which stiffening is provided by the piezoelectric stiffener 322. By rotating a switch (not shown), the golfer can determine the amount of flexion required in the golf club shaft 310 required for activation of the piezoelectric stiffener 322.

The control circuit 80 can be configured so that at slow swing speeds, electrical signals from the sensor 324 are shunted in an opposite direction across the piezoelectric stiffener, causing additional flexing of the golf club shaft 310. The variable resistor 82 (or alternatively a non-variable resistor) can then be used to bleed off the energy from the sensor at the higher swing speeds.

Figure 10:
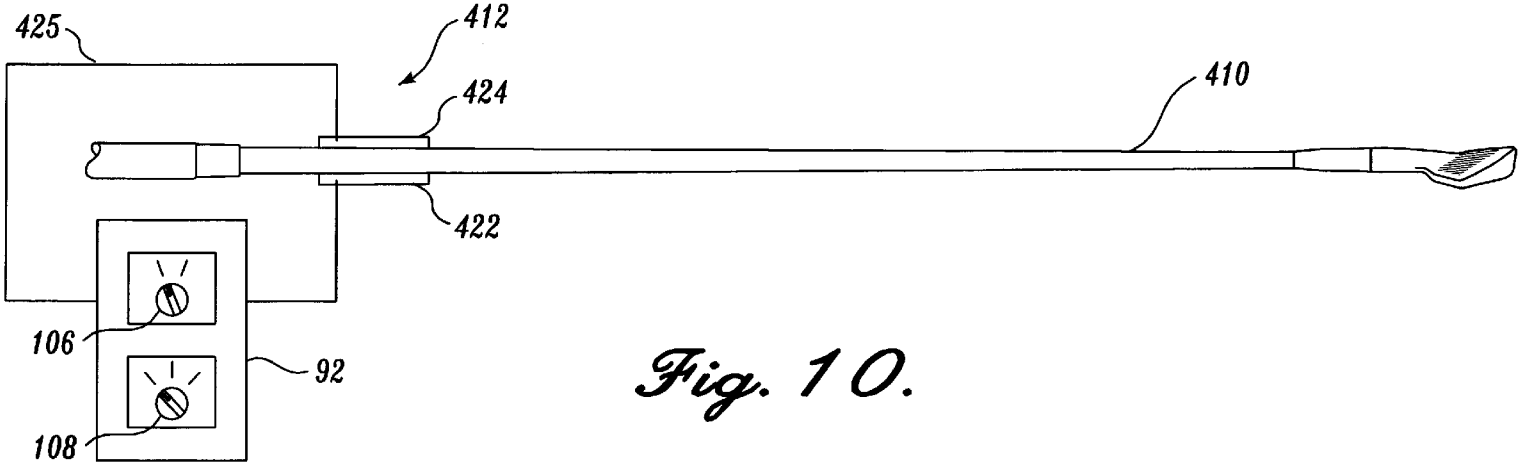
FIG. 10 is a diagrammatic top view of a fifth embodiment of the present invention incorporating an active piezoelectric device.
Figure 11:
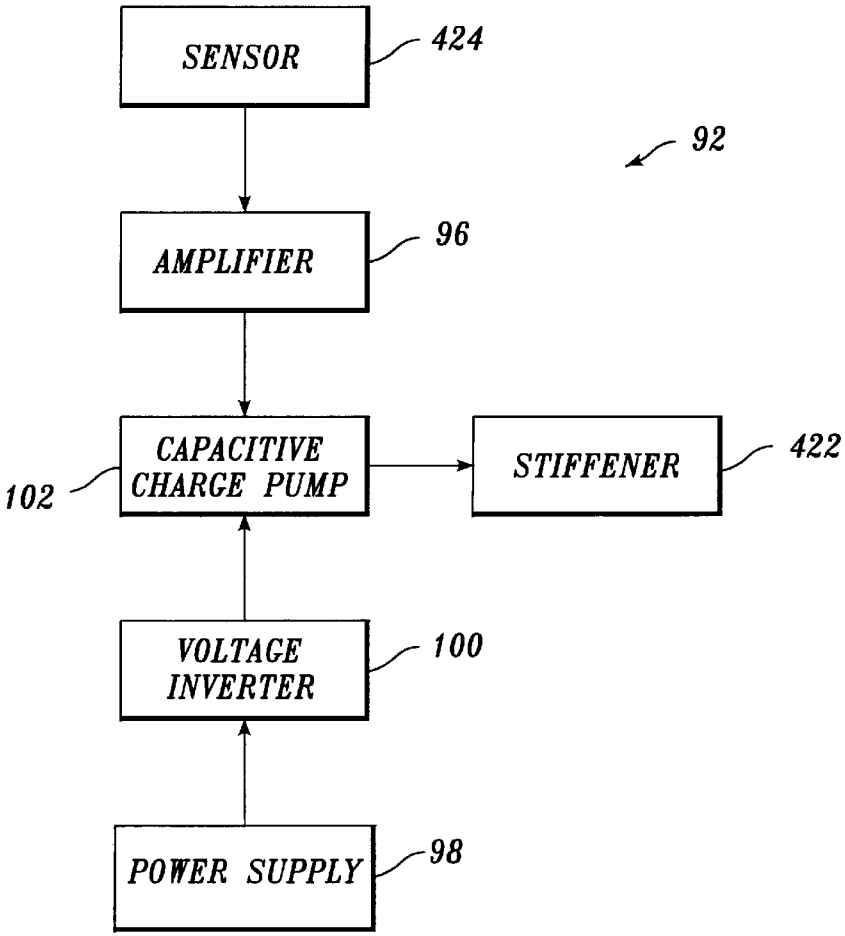
FIG. 11 displays the control circuit for the active piezoelectric device of FIG. 10.

Thus far, the embodiments described have been directed to passive piezoelectric devices. That is, the piezoelectric devices 12, 112, 212, and 312 do not include an external power source. FIGS. 10 and 11 illustrate an embodiment of the invention including an active piezoelectric device 412 having an external power source.

In the active piezoelectric device 412, a piezoelectric stiffener 422 is used that is similar to the piezoelectric stiffener 22 discussed above. However, in the active piezoelectric device 412 shown in FIG. 10, the function and operation of the control circuit differs. As with the passive systems described above, in an active configuration, a circuit 425 provides an electrical signal to the piezoelectric stiffener 422 from the sensor 424. However, as is described in detail below, in an active configuration such as is shown in FIGS. 10 and 11, the electrical signal from the sensor 424 is intensified by a control circuit 92. In addition, an active piezoelectric device can be used to reverse polarity across the piezoelectric stiffener 422 so as to cause the piezoelectric device 412 to pull the golf club shaft 410 in an opposite direction so as to add additional flex to the golf club shaft.

As is shown in FIG. 11, the control circuit 92 includes an amplifier 96, a power supply 98, a voltage inverter 100 and a capacitive charge pump 102. The control circuit 92 is housed within the golf club shaft 10 preferably at or near the butt 14.

The power supply 98 is preferably a small, powerful battery such as a camera battery due to its small size and large energy storage capacity. The capacitive charge pump 102 is used due to its relatively small size and weight, and its relative immunity to the effects of vibration, temperature and humidity.

The control circuit 92 is connected to the piezoelectric stiffener 422 through the circuit 425. The circuit 425 extends from the control circuit 92 along the golf club shaft 10 to the piezoelectric stiffener 22. In the preferred embodiment, the control circuit 92 includes an on/off switch 106 and a variable stiffening switch 108. These switches 106, 108 can be located on the butt of the golf club shaft or at another place that does not interfere with the grip or swing of the golfer.

The control circuit 92 is turned on or off by the golfer through the use of the on/off switch 106. The golfer adjusts the amount of stiffening provided by the piezoelectric stiffener 422 by adjusting the variable stiffening switch 108 to a high, medium or low setting. The high, medium or low settings determine the magnitude of the voltage provided by the voltage inverter 100. The variable stiffening switch 108 adjusts the magnitude of the control signal provided to the piezoelectric stiffener 422 by the capacitive charge pump 102. The high, medium or low settings thus allow the golfer to adjust the amount of stiffening provided by the piezoelectric stiffener 422.

In operation, as the body of the golf club shaft 410 flexes or deforms, the sensor 424 produces a signal indicative of the golf club shaft's deformation. This signal is passed to and amplified by the amplifier 96. The amplified signal is used to trigger the capacitive charge pump 102. The capacitive charge pump 102 is electrically charged by an electrical current from the power supply 98. The electrical current is first passed through the voltage inverter 100 to obtain the desired voltages. When the capacitive charge pump 102 receives a signal from the sensor 424 indicative of a deformation in the golf club shaft 410, the capacitive charge pump provides an electrical control signal to the piezoelectric stiffener 422. This control signal energizes the piezoelectric stiffener 422, causing the piezoelectric stiffener to lengthen or contract. As the sensor 424 detects deflections of greater magnitude, a control signal of greater magnitude is provided to the piezoelectric stiffener 422, thus increasing the piezoelectric stiffener's resistance to deflections within the body of the golf club shaft.

In alternate embodiments of the invention, other control circuit designs could be used without departing from the scope of the invention. As well known by those of ordinary skill in the electrical control art, many different control circuit layouts and designs can be used to produce similar results to those discussed above.

Figure 12:
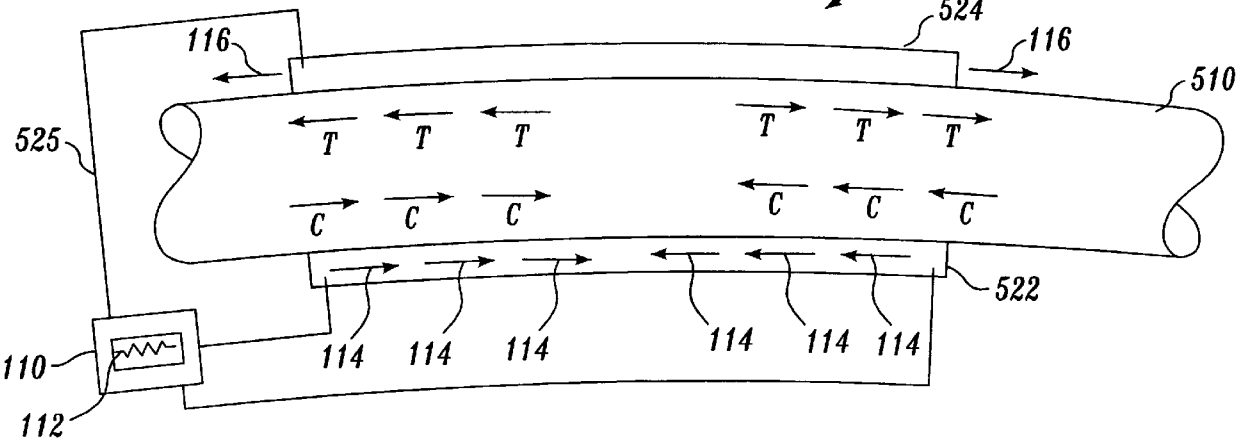
FIG. 12 is a diagrammatic view of a sixth embodiment of the present invention in which an active piezoelectric device increases bending of the golf club shaft responsive to slow swings of the golf club shaft.

FIG. 12 shows an alternate embodiment of a golf club shaft 510 embodying an active piezoelectric device 512. The piezoelectric device 512 includes a sensor 524 and a piezoelectric stiffener 522. A circuit 525 extends between the piezoelectric stiffener 522 and the sensor 524, and includes a control circuit 110 therein. The control circuit 110 includes a resistor 112, the function of which will be described in detail below.

The control circuit 110 is preferably an active-piezoelectric control circuit similar to that shown in FIG. 11. As with the embodiment shown in FIG. 11, the control circuit 110 provides a variety of different inputs to the piezoelectric stiffener 522 depending upon the swing speed of the golf club shaft 510 and the reaction of the sensor 524.

Figure 13:
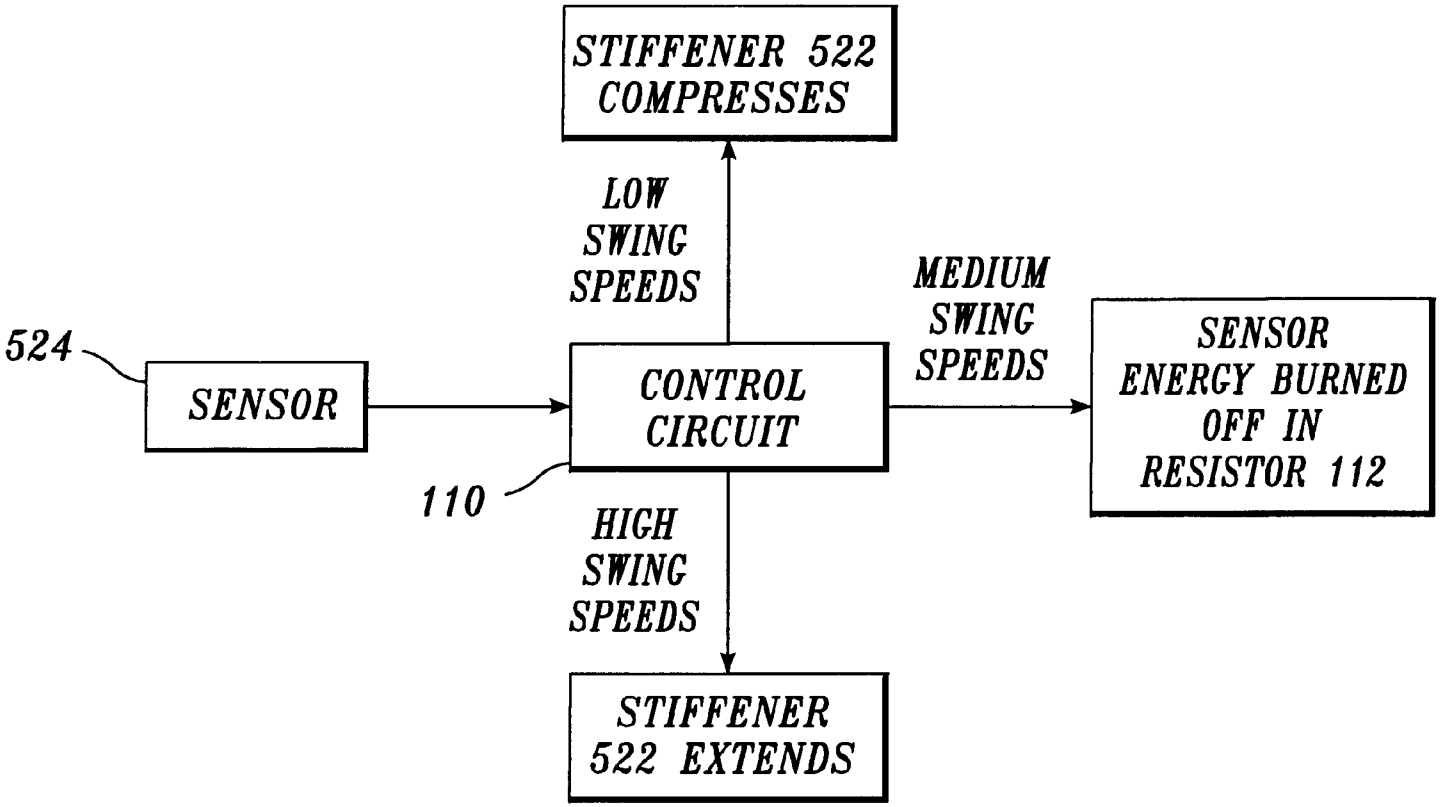
FIG. 13 is a diagram displaying the control circuit for the golf club shaft of FIG. 12.

As can be seen in FIGS. 12 and 13, control circuit 110 is designed such that at low swing speeds, the control circuit 110 directs the electrical potential from the sensor 524 through the piezoelectric stiffener 522 to cause the piezoelectric stiffener to compress (indicated by the arrows 114 in FIG. 12). The piezoelectric stiffener 522 therefore causes the golf club shaft 510 to flex an additional amount at the area of the piezoelectric device 512. In this manner, the piezoelectric device 512 adds additional kick to the club, and can be used to increase the acceleration of the club head on a slower swing.

At a medium swing speed of the golf club shaft 510, the control circuit 110 takes the electrical potential from the sensor 524 and burns that energy off in the resistor 112. The piezoelectric stiffener 522 is not used on these medium swings.

At higher swing speeds, the control circuit 110 takes the electrical potential from the sensor 524 and shunts the potential across the piezoelectric stiffener 522 in an opposite direction than with the slow swings, causing the piezoelectric device to extend, much as is done in FIG. 5. Thus, the piezoelectric device 512 is used to counteract bending of the golf club shaft 510 at the location of the piezoelectric device 512, and the golf shaft 510 is locally increased in stiffness.

Other control circuits can be provided by a person of skill in the art to produce similar results to those discussed above, or to create a golf club shaft having variable stiffness and/or kick points. In addition, a number of different circuits and/or arrangements of piezoelectric devices can be used to produce a golf club shaft having variable stiffness, or to selectively relocate the kick point of the golf club shaft. The sensors and piezoelectric stiffener can be located at different locations along the golf club shaft 10 so as to provide different results. In addition, the sensor and the piezoelectric stiffener can be located on the same side of the club, or could even be formed from the same piezoelectric material.

By moving or influencing the kick point of the golf club shaft 10, the piezoelectric device of the present invention effectively changes the deflection of the golf club shaft and moves the kick point to a different location. A golf club shaft made of materials that would typically deflect along a regular, or flexible golf club shaft deflection curve can be altered so as to selectively deflect along a deflection curve of a stiff shaft at higher swing speeds. In this manner, the golf club shaft 10 can be tailored so as to behave as a stiffer shaft for a golfer on a high velocity swing and to behave as a more flexible shaft on a slower swing velocity. Thus, the golf club shaft is loaded properly on all swing speeds so as to achieve the best club face alignment and maximize club head velocity at impact.

While the preferred embodiment of the invention has been illustrated and described with reference to preferred embodiments thereof, it will be appreciated that various changes can be made therein without departing from the spirit and scope of the invention as defined in the appended claims.

The embodiments of the invention in which an exclusive property or privilege is claimed are defined as follows:

1. A golf club shaft comprising:

a longitudinal axis; and a piezoelectric device comprising:

a sensor located along the golf club shaft and configured such as to produce an electrical signal upon flexing of the golf club shaft; and a piezoelectric stiffener electrically connected to the sensor, located along the golf club shaft, and designed to mechanically deform as a result of receiving the electrical signal from the sensor, the mechanical deformation of the piezoelectric stiffener causing a corresponding deflection of the golf club shaft, wherein the sensor is located on an opposite side of the golf club shaft from the piezoelectric stiffener.

2. A golf club shaft comprising:

a longitudinal axis; and a piezoelectric device, comprising:

a sensor located along the golf club shaft and configured such as to produce an electrical signal upon flexing of the golf club shaft; and a piezoelectric stiffener electrically connected to the sensor, located along the golf club shaft, and designed to mechanically deform as a result of receiving the electrical signal from the sensor, the mechanical deformation of the piezoelectric stiffener causing a corresponding deflection of the golf club shaft, wherein the piezoelectric stiffener is located on a forward, target-facing side of the golf club shaft, and wherein the mechanical deformation of the piezoelectric stiffener is compression in length along an axis that is parallel to the longitudinal axis.

3. The golf club shaft of claim 2, wherein the sensor is located on an opposite side of the golf club shaft from the piezoelectric stiffener.

4. The golf club shaft of claim 2, wherein the piezoelectric stiffener is located upon a trailing, away-from-target side of the golf club shaft and wherein the mechanical deformation of the piezoelectric stiffener is elongation in length along an axis that is parallel to the longitudinal axis.

5. A golf club shaft comprising:

a longitudinal axis; and a piezoelectric device comprising:

a sensor located along the golf club shaft and configured such as to produce an electrical signal upon flexing of the golf club shaft; and a piezoelectric stiffener electrically connected to the sensor, located alone the golf club shaft, and designed to mechanically deform as a result of receiving the electrical signal from the sensor, the mechanical deformation of the piezoelectric stiffener causing a corresponding deflection of the golf club shaft, wherein the piezoelectric device comprises piezoelectric material that extends substantially around the circumference of the golf club shaft.

6. The golf club shaft of claim 5, wherein the piezoelectric stiffener comprises a portion of the piezoelectric material extending around the circumference, and the sensor comprises another portion of the piezoelectric material extending around the circumference.

7. A golf club shaft comprising:

a longitudinal axis; and a piezoelectric device, comprising:

a sensor located along the golf club shaft and configured such as to produce an electrical signal upon flexing of the golf club shaft; and a piezoelectric stiffener electrically connected to the sensor, located along the golf club shaft, and designed to mechanically deform as a result of receiving the electrical signal from the sensor, the mechanical deformation of the piezoelectric stiffener causing a corresponding deflection of the golf club shaft, further comprising a control circuit in the electrical connection between the sensor and the piezoelectric device, the control circuit being configured so as to selectively restrict the flow of the electrical signal from the sensor to the piezoelectric stiffener, thus providing mechanical deformations of the piezoelectric stiffener only at selected flexions of the golf club shaft.

8. The golf club shaft of claim 7, wherein the control circuit comprises a resistor that bleeds off the electrical signal of the sensor at flexions of the golf club shaft corresponding to lower swing speeds, and permits stiffening by the piezoelectric stiffener at flexions of the golf club shaft at swing speeds higher than the lower swing speeds.

9. The golf club shaft of claim 8, wherein the resistor comprises a variable resistor.

10. A golf club shaft comprising:

a longitudinal axis; and a piezoelectric device, comprising:

a sensor located along the golf club shaft and configured such as to produce an electrical signal upon flexing of the golf club shaft; and a piezoelectric stiffener electrically connected to the sensor, located along the golf club shaft, and designed to mechanically deform as a result of receiving the electrical signal from the sensor, the mechanical deformation of the piezoelectric stiffener causing a corresponding deflection of the golf club shaft, and wherein the piezoelectric stiffener is configured so that the mechanical deformation at low swing speeds of the golf club shaft causes additional flexing of the golf club shaft, further comprising a control circuit in the electrical connection between the sensor and the piezoelectric device, the control circuit being configured so as to selectively restrict the flow of the electrical signal from the sensor to the piezoelectric stiffener, thus providing mechanical deformations of the piezoelectric stiffener only at selected flexions of the golf club shaft.

11. The golf club shaft of claim 10, wherein the control circuit comprises a resistor that bleeds off the electrical signal of the sensor at flexions of the golf club shaft corresponding to swing speeds higher than the low swing speeds.

12. The golf club shaft of claim 11, wherein the resistor comprises a variable resistor.

13. The golf club shaft of claim 11, wherein the resistor bleeds off the energy of the sensor at flexions of the golf club shaft intermediate the lower swing speeds and higher swing speeds, and wherein the mechanical deformations cause the piezoelectric stiffener to stiffen the golf club shaft at the higher swing speeds.

* * * * *